United States Patent [19]

Honma et al.

[11] 3,978,917

[45] Sept. 7, 1976

[54] DESCALING SYSTEM FOR THE COOLING WATER TUBES OF A STEAM CONDENSER

[75] Inventors: Yoshio Honma, Yokosuka; Junichi Takahashi, Yokohama, both of Japan

[73] Assignees: Tokyo Shibaura Electric Co., Ltd., Kawasaki; Toshiba Engineering Co., Ltd., Nishishinbashi, both of Japan

[22] Filed: Sept. 5, 1974

[21] Appl. No.: 503,315

[30] Foreign Application Priority Data

Oct. 22, 1973 Japan ..... 48-121658[U]

[52] U.S. Cl. ..... 165/95; 15/3.51

[51] Int. Cl.[2] ..... F28G 1/00

[58] Field of Search ..... 165/95; 15/3, 3.51

[56] References Cited

UNITED STATES PATENTS

| | | | |
|---|---|---|---|
| 1,992,425 | 2/1935 | Hatchel | 15/3.51 X |
| 2,076,414 | 4/1937 | Panagopoulos | 15/3.51 |
| 2,096,714 | 10/1937 | Haldane | 15/3.51 |
| 2,134,493 | 10/1938 | Uroukoff | 15/3.51 |
| 2,660,744 | 12/1953 | Cockrell | 15/3 |
| 2,670,723 | 3/1954 | Clarkson | 165/95 X |
| 2,839,768 | 6/1958 | Suchecki | 15/3.51 |
| 3,021,117 | 2/1962 | Taprogge | 165/95 |
| 3,393,564 | 7/1968 | Simmons | 165/95 X |
| 3,473,961 | 10/1969 | Heeren et al. | 15/3.51 X |
| 3,707,442 | 12/1972 | Takahashi et al. | 165/95 X |
| 3,872,920 | 3/1975 | Honma et al. | 165/95 |
| 3,882,931 | 5/1975 | Kumagai | 165/95 |

FOREIGN PATENTS OR APPLICATIONS

| | | | |
|---|---|---|---|
| 525,797 | 5/1931 | Germany | 15/3.51 |

*Primary Examiner*—Albert W. Davis, Jr.
*Assistant Examiner*—Sheldon Richter
*Attorney, Agent, or Firm*—Oblon, Fisher, Spivak, McClelland & Maier

[57] ABSTRACT

Descaling elements for cleaning cooling water tubes within a steam condenser are received within a water soaking vessel. A wire net is stretched within said vessel, and said vessel is charged with water until the water level reaches a predetermined limit line above said wire net. The presence of the wire net prevents the descaling elements from being floated up to the water surface. A considerably large space is formed between the water surface and the ceiling of the vessel. Said space communicates with an evacuating device for deaerating the interior of the vessel, and no air filter or air separator is required for said evacuating device.

4 Claims, 1 Drawing Figure

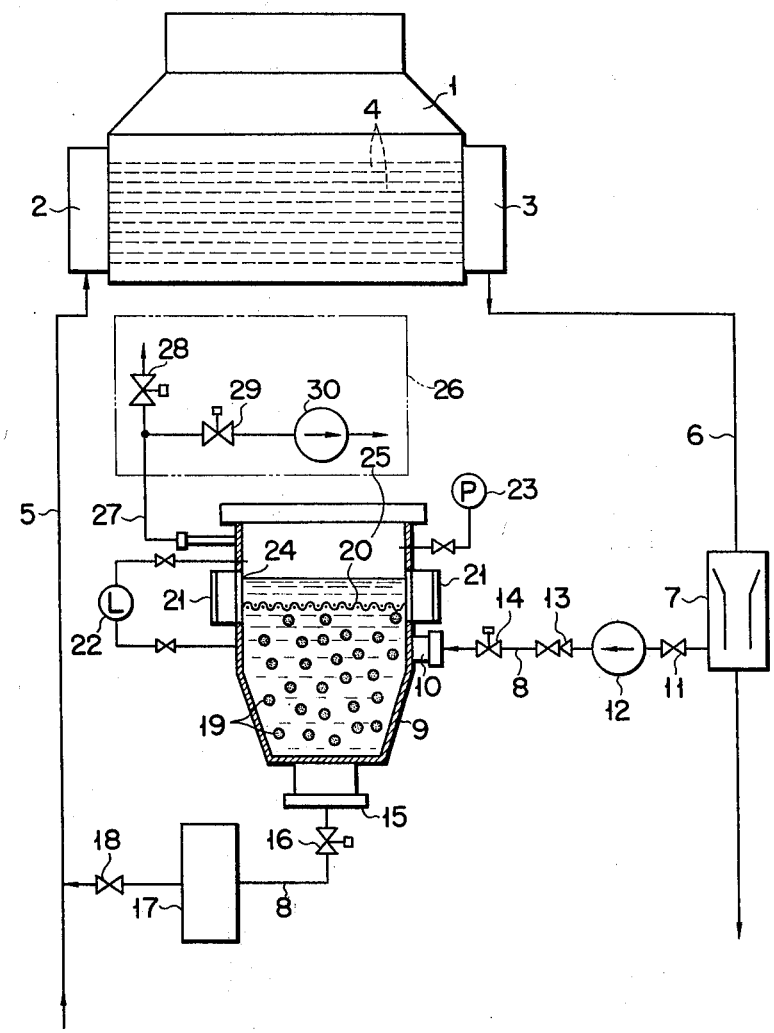
1
4
2
3
28
29
30
26
6
25
P
23
5
27
24
20
21
21
14
13
7
L
22
10
8
12
11
19
9
15
18
16
17
8

DESCALING SYSTEM FOR THE COOLING WATER TUBES OF A STEAM CONDENSER

BACKGROUND OF THE INVENTION

This invention relates to the heat exchanging tubes of a heat exchanger, and more particularly to a descaling system for cleaning the cooling water tubes of a steam condenser, and further in detail to a descaling system for removing substances deposited on the inner walls of the cooling water tubes of a steam condenser by continuously forcing a large number of descaling elements such as water-soaked sponge balls through said tubes.

As above described, a descaling system is known which uses water-holding descaling elements for the purpose of cleaning the steam condenser tubes. For example, in the known descaling system a circulation passageway for passing descaling elements therethrough connects with the cooling water inlet pipe and outlet pipe of a steam condenser. In the course of said passageway a water-soaking vessel within which descaling elements are received and which is charged with cooling water is provided. Said vessel is provided with an evacuating device for evacuating the vessel interior up to a prescribed vacuum level. Said evacuating device is generally provided with plural deaeration valves and vacuum pump or air ejector and, in addition, provided with an air filter or air separator for removing water so as to prevent it from entering said pump or ejector.

The above-mentioned descaling system has the drawbacks that all of the descaling elements can not be evenly, fully soaked with water because many of the descaling elements are floated up to the proximity of the water surface within the vessel; and a water separator or filter should be provided and the piping line should also be of water-resistant quality because when the vessel interior is deaerated by the evacuating device, water is also soaked into the piping line of said device, resulting in a complicated construction of the evacuating device and an increase in its manufacturing cost.

SUMMARY OF THE INVENTION

The general object of the invention is to provide an improved descaling system eliminating the drawbacks in the foregoing conventional descaling system.

In the descaling system of the invention, a wire net is stretched within a water-soaking vessel having descaling elements received therein; said descaling elements are received below said wire net; said vessel is charged with water up to a predetermined limit line above the wire net; said wire net is in a state always immersed in water during the water soaking operation for the descaling elements; and a considerably large volume of space is provided in the upper part of the vessel interior and the water within the vessel has a free surface.

Accordingly, in the descaling system of the invention, when the water-soaking vessel is deaerated by an evacuating device associated with said vessel, there is a reduced possibility of water being entered into the piping line of said device because of the presence of a considerably large volume of space. As the result, the necessity of providing a water filter or water separator within said device is reduced, offering the advantage of attaining the manufacturing cost reduction of the evacuating device.

Since the descaling elements are prevented from being floated on the water surface by the wire net, they are fully immersed in the water, offering the advantage of reliably enabling the water soaking.

Accordingly, an object of the invention is to provide a descaling system low in manufacturing cost.

Another object of the invention is to provide a descaling system enabling the water soaking operation for the descaling elements to be reliably carried out, thereby attaining a good descaling effect.

A still another object of the invention is to provide a descaling system enabling the water soaking operation for the descaling elements to be carried out for a short time with high efficiency.

BRIEF DESCRIPTION OF THE DRAWINGS

Further objects and advantages of the invention can be more fully understood from the following detailed description taken in conjunction with the accompanying drawing schematically showing a descaling system according to an embodiment of the invention.

DESCRIPTION OF THE PREFERRED EMBODIMENT

In the FIGURE, a steam condenser 1 is provided at one side with an inlet water box 2 and at the other side with an outlet water box 3. Between the both water boxes 2 and 3, a large number of cooling water tubes 4 are installed within the steam condenser 1. A cooling water feed pipe 5 communicates with said inlet water box 2 so as to feed cooling water, for example, sea water into the cooling water tubes 4 by means of a known cooling water circulation pump not shown. On the other hand, a cooling water discharge pipe 6 communicates with said outlet water box 3 so as to drain off the used cooling water. In the proper intermediate portion of the water discharge pipe 6 a collector 7 is installed. Said collector 7 is intended to catch a large number of sponge balls 19 alone later described which are used as descaling elements for cleaning the interior of the cooling water tubes 4 in the descaling system of the invention. Said descaling system is installed between the cooling water feed pipe 5 and the collector 7.

A sponge ball circulation passageway 8 is provided between the feed pipe 5 and the collector 7. In the substantially middle position of said passageway 8 a water-soaking vessel 9 is installed. The inlet 10 of said water-soaking vessel 9 communicates with the collector 7 through the circulation passageway 8 on the upstream side. In the passageway 8 on the upstream side valve 11, sponge ball circulation pump 12, check valve 13 and inlet valve 14 are installed in turn. On the other hand, the outlet 15 of the water-soaking vessel 9 communicates with the feed pipe 5 through the circulation passageway 8 on the downstream side. In the passageway 8 on the downstream side an outlet valve 16, a reservoir 17 for collecting used sponge balls, and valve 18 are installed in turn.

When the descaling system is out of operation, both valves 11 and 18 are in a closed condition. When said both valves 11 and 18 are in a closed condition, the steam condenser 1 makes the following normal operation. Cooling water is pumped up, for example, from the sea by cooling water pumps, and introduced into the cooling water tubes 4 from the inlet water box 2 via the feed pipe 5, and heat exchange is effected on the tube surface. Thereafter, the used cooling water is collected into the outlet water box 3 and then drained off into the sea through the discharge pipe 6.

Said water soaking vessel 9 is a sufficiently large hopper-shaped vessel and is cylindrical within its substantially upper half so as to have the same inner diameter along its length. Within said vessel a sealed space having a fixed volume is formed. Within said space sponge balls 19 of the amount necessary to descale the interiors of the cooling water tubes 4 of the steam condenser 1 are received. A wire net 20 is stretched within the vessel 9. The meshes of the wire net 20 are each formed small enough to prevent any sponge ball 19 from passing therethrough. The vessel 9 is formed with an opening at its proper position below the wire net 20, and provided with a cover usually closing the opening. New sponge balls are supplied into the vessel 9 from the opening. Since, however, the construction of said opening portion is irrelevant to the subject matter of the invention, the illustration and detailed description thereof are omitted.

The water-soaking vessel 9 is provided at its outer wall with a peep window 21 facing the wire net 20. Further, the vessel 9 is also provided with a level gauge 22 for measuring the level of water in the vessel 9 and a pressure gauge 23 for measuring the pressure of air within the vessel 9.

As later described in detail, a limit line 24 for the water level is previously set at the predetermined position of the vessel interior upwardly distant from the wire net 20, and water is charged into the vessel up to said limit line 24, the level gauge 22 confirming whether or not the water level has reached the limit line 24. The charged water has a free surface at the limit line 24. A considerably large volume of space 25 is formed between the water surface and the vessel ceiling.

An evacuating device 26 for deaerating the interior of the vessel 9 is shown enclosed in block by a two dots-and-dash line. A deaeration pipe 27 within the device 26 is connected at one end to the vessel 9 so as to communicate with the space 25 of the vessel 9, and is divided at the other end into two branch pipes, one of which is opened to the atmosphere via a deaeration valve 28 and the other of which is connected to a vacuum pump 30 via another deaeration valve 29. Said vacuum pump 30 may be replaced by an ordinary air extracting means, for example, an air ejector. However, the evacuating device 26 does not have to be provided with an air filter or air separator required for the conventional evacuating device.

There will now be described the operation of the descaling system according to the embodiment of the invention for cleaning the cooling water tubes of a steam condenser.

First, the outlet valve 16 is closed, and the deaeration valve 28 within the evacuating device 26 is simultaneously opened. Thereafter, all required sponge balls 19 used as the descaling elements are introduced below the wire net 20 within the water-soaking vessel 9. Thereafter, the inlet valve 14 and the valve 11 are opened, and water is charged into the vessel 9 through the circulation passageway 8 on the upstream side. The water charging is effected with precision through the careful observation of the level gauge 22 until the water level reaches the limit line 24. The water charging gives rise to the floating of the sponge balls 19 within the vessel 9, but the presence of the wire net 20 prevents said balls from being floated on the water surface. It should be noted that the wire net 20 is so firmly fixed to the vessel 9 as not to be displaced by the upward pushing force of the sponge balls 19.

On completion of water charging, the inlet valve 14 is closed. Thereafter, the evacuating device 26 is operated. Namely, one deaeration valve 28 heretofore opened is closed and simultaneously the other deaeration valve 29 is opened, and the vacuum pump 30 is driven. At this time, the vessel 9 is deaerated via the deaeration pipe 27, thereby reducing the vessel interior to below the atmospheric pressure. The vacuum level of the vessel interior is increased up to a prescribed level while read by the pressure gauge 23. Through said operation, bubbles are produced from the sponge balls 19 within the vessel 9, thereby causing the air contained within the balls 19 to escape therefrom, and water is instead absorbed into the balls. Thus, the first step of the soaking operation for the sponge balls 19 is completed. Sequentially, the vacuum pump 30 is stopped and simultaneously the deaeration valve 29 is closed, and the deaeration valve 28 is again opened. Since, at this time, the deaeration pipe 27 is opened to the atmosphere, the vessel interior pressure heretofore maintained in a state having a prescribed vacuum level is increased up to the atmospheric pressure. The air remaining slightly left within the sponge balls 19 is thus shrunk due to the action of the atmospheric pressure, thereby causing the ambient water to be absorbed into the balls, so that the respective balls 19 hold water to the full extent. Thus, the second step of the soaking operation for the sponge balls is completed. During said second step of the soaking operation, the atmospheric pressure is applied to the entire free surface of water. Therefore, this soaking operation is completed in an extremely short time.

It can easily be confirmed by observing the vessel interior through the peep window 16 whether or not said first and second steps of the soaking operation are completed.

As described above, through the first and second steps of the soaking operation process the air contained within the sponge balls 19 is caused to escape therefrom, and water within the vessel is instead absorbed into the balls, so that the water level first located on the limit line 24 is lowered. For the following reasons, however, the limit line 24 is so set as to prevent the water level after lowered from being positioned below the wire net 20.

That is, if a distance between the wire net 20 and the limit line 24 is denoted by $L$(cm), then $L$ will be expressed by the equation:

$$L = 4q/\pi D^2 + \alpha$$

where $Q$(cc) represents a value obtained from multiplication of the water content per sponge ball by the number of balls received within the vessel; $D$(cm) the inner diameter of the vessel; and $\alpha$(cm) an additional safety coefficient, preferably ranging from 1 cm to 2 cm in actual cases.

Since the limit line 24 for the water level is set in this manner, the wire net 20 is always immersed in the water during the soaking operation. For this reason, the sponge balls 19 are completely prevented from being floated on the water surface, thereby effectively performing the water soaking operation for the balls.

Further, since the space 25 is formed considerably large by preventing the water level from rising above the limit line 24, very little water in the vessel enters into the deaeration pipe 27 when the deaeration device 26 is driven. Accordingly, no air filter or air separator for avoiding entry of the water into the vacuum pump 30 is substantially required. The deaeration pipe 27 does not have to be made, in particular, of water-resistant quality material. Simply for safety, however, a relatively inexpensive air separator may be provided on the upstream side of the vacuum pump 30.

In the foregoing soaking operations, the water-soaking vessel 9 is previously charged with water, and thereafter the vessel interior is deaerated by the deaeration device 26. Conversely, however, it is also possible to first perform the deaeration of the vessel interior and then perform the water charging into the vessel, and the function and effect obtained are actually the same as those attainable in the former case.

Where, as above described, the soaking operation is carried out as desired, the inlet valve 14 and the valve 11 are opened and simultaneously the outlet valve 16 and the valve 18 are opened, and the circulation pump 12 is driven. As the result, a fully soaked sponge balls 19 within the vessel 9 are forcibly extruded into the circulation passageway on the downstream side due to the action of the discharge pressure of the circulation pump 12. The balls 19 pass through the reservoir 17 and enter the cooling water feed pipe 5. The reservoir 17 is provided for the purpose of collecting the used sponge balls and, only when they are collected, shuts off the passageway 8 but normally opens the passageway 8 to permit the passage of the balls 19.

The sponge balls 19 having entered the cooling water feed pipe 5 are entered into the inlet water box 2 together with the cooling water and are then introduced into the cooling water tubes 4 of the steam condenser 1. Since, the respective sponge balls 19 already hold water to the full extent, they are prevented from floating in the water box 2, and are accordingly introduced into the cooling water tubes 4 in a uniformly distributed state. When the balls pass through the interiors of the tubes 4, substances deposited onto the inner walls of the tubes are rubbed off by the balls. Then, the balls flow out into the outlet water box 3 in a state wherein said deposited substances are adhered to the balls, and are drained off into the discharge pipe 6.

After transferred into the discharge pipe 6, the sponge balls are returned to the circulation passageway 8 through the collector 7. By continuously driving the circulation pump 12, the sponge balls 19 are repeatedly passed through the cooling water tubes 4 of the steam condenser, thereby enabling the expected descaling of the inner walls of the tube. After completion of the expected descaling, the circulation pump 12 is stopped and simultaneously the balls 19 are all collected by the reservoir 17. Then, the valves 11 and 18 are closed.

The water soaking vessel 9 can be designed to concurrently function as the reservoir 17. In this case, the reservoir 17 becomes unnecessary. The condition in which the used sponge balls 19 are collected into the vessel 9 can be observed through the peep window 21. The collected sponge balls can be drawn out to the exterior through an opening (not shown) which is provided for the vessel.

What we claim is:

1. A descaling system for cleaning the inner walls of cooling water tubes of a steam condenser by passing a large number of descaling elements through said tubes, comprising:

cooling water tubes of a steam condenser;

a circulation passageway for cyclically feeding said descaling elements into said cooling water tubes, said passageway having one end connected to a cooling water feed pipe communicating with one end of said steam condenser and the other end connected to a cooling water discharge pipe communicating with the other end of said steam condenser;

a water soaking vessel provided in said circulation passageway and having a large number of descaling elements disposed therein which are capable of absorbing water;

evacuating means communicating with said vessel for increasing the interior pressure of said vessel to a prescribed vacuum level for promoting the absorbancy of water into said descaling elements, means for feeding the descaling elements into the circulation passageway from the vessel and for forcibly introducing the same into the cooling water tubes of the steam condenser together with cooling water, thereby cleaning the respective inner walls of the cooling water tubes, means for determining a limit line level of water to be charged into the vessel whereby a relatively large volume of space is formed between the water level and the vessel ceiling in the upper part of the vessel, said evacuating device being connected to the vessel so as to communicate with said space; and means disposed within said vessel for preventing a large number of said descaling elements disposed in the vessel from floating upon the surface of said water charged into the vessel.

2. A descaling system according to claim 1 wherein a water level gauge for confirming that the level of water charged in the vessel has reached said limit line is provided upon the outer wall of the vessel.

3. A descaling system according to claim 1, wherein:

said preventing means is a wire net fixed to the water soaking vessel, said wire net is located at a prescribed distance downwardly from said limit line, and said prescribed distance is so determined that even when the water level is lowered to below said limit line during the water absorbancy operation, the water level, after being lowered, is positioned substantially above the wire net.

4. A descaling system according to claim 3 wherein peep windows, for allowing the vessel interior to be observed therethrough, are provided upon the outer wall of the vessel at a level corresponding to that of said wire net.

* * * * *